US007779935B2

(12) United States Patent
Jagert et al.

(10) Patent No.: US 7,779,935 B2
(45) Date of Patent: Aug. 24, 2010

(54) MECHANICALLY ENGAGED AND RELEASABLE CONNECTION SYSTEM

(75) Inventors: Fred Jagert, Langdon (CA); Xu Shijie, Calgary (CA)

(73) Assignee: National Oilwell Varco, L.P., Houston, TX (US)

( * ) Notice: Subject to any disclaimer, the term of this patent is extended or adjusted under 35 U.S.C. 154(b) by 39 days.

(21) Appl. No.: 12/135,792

(22) Filed: Jun. 9, 2008

(65) Prior Publication Data

US 2009/0301711 A1 Dec. 10, 2009

(51) Int. Cl.
*E21B 17/02* (2006.01)

(52) U.S. Cl. ..... 175/321; 166/242.7

(58) Field of Classification Search ..... 175/320, 175/321; 166/242.7
See application file for complete search history.

(56) References Cited

U.S. PATENT DOCUMENTS 5,984,029 A * 11/1999 Griffin et al. ..... 175/321
6,131,953 A * 10/2000 Connell et al. ..... 285/3
6,186,249 B1 2/2001 Bjornstad
6,244,345 B1 6/2001 Helms
6,318,470 B1 11/2001 Chang et al.
2003/0102132 A1* 6/2003 Estep et al. ..... 166/377

FOREIGN PATENT DOCUMENTS

GB 326893 3/1930

OTHER PUBLICATIONS

PCT/US2009/046364 International Search Report and Written Opinion, Jan. 14, 2010.

* cited by examiner

*Primary Examiner*—William P Neuder
(74) *Attorney, Agent, or Firm*—Conley Rose, P.C.

(57) ABSTRACT

An apparatus for mechanically engaging and releasably coupling two tubular members may include a first housing member, a second housing member and a piston member, wherein, in a first position, the first and second housing members are fixed relative to each other by the piston, and wherein, in a second position, the second housing member is rotatable relative to the first housing member. Certain embodiments include matingly engaged axially disposed and axially offset splines. Other embodiments include first and second interlocking mechanisms that are in an opposed relationship to couple first and second tubular members in a fixed position. Some embodiments include a method of reacting a first rotational coupling against a second axial coupling to resist both axial and rotational movement between first and second tubulars. Other embodiments include displacing a moveable member to both axially and rotationally release first and second tubulars.

20 Claims, 5 Drawing Sheets

MECHANICALLY ENGAGED AND RELEASABLE CONNECTION SYSTEM

BACKGROUND

The present disclosure relates generally to a releasable connection for a downhole assembly. More particularly, the present disclosure relates to a mechanically engaged and releasable connection that may be disposed between a tool string and a downhole tool and actuated to disconnect the downhole tool from the tool string upon application of an axial load.

To form an oil or gas well, a bottom hole assembly (BHA), including components such as a motor, steering assembly and drill bit, is coupled to an end of a drillstring and then inserted downhole, where drilling commences. When forming a substantially straight borehole, the drillstring typically includes a number of pipe joints threaded end to end. Circumstances may arise in which it is desirable to disconnect the drillstring from the BHA, for example, when the BHA becomes stuck in the borehole during drilling. At such times, the drillstring is disconnected from the BHA by applying torque to the drillstring and uncoupling a threaded connection between the drillstring and the BHA. Once disconnected from the BHA, the drillstring may be extracted from the borehole and the stuck BHA subsequently retrieved via fishing, jarring or another operation.

When forming a deviated, lateral or upwardly sloping borehole, it is not economically feasible or practical to use a drillstring made from jointed pipe. Instead, the BHA may be coupled to coiled tubing, which includes one or more lengths of continuous, unjointed tubing spooled onto reels for storage in sufficient quantities to exceed the maximum length of the borehole. Because the coiled tubing cannot be disconnected from the BHA by the application of torque to the coiled tubing, an axial disconnect is positioned in the tubing string between the BHA and the coiled tubing prior to insertion of the tubing string downhole. The axial disconnect facilitates decoupling of the coiled tubing from the BHA in the event that it becomes desirable to do so, such as when the BHA becomes stuck during drilling. To decouple the BHA from the coiled tubing, the disconnect is actuated to allow the BHA to disconnect from the coiled tubing upon application of an axial load to the coiled tubing. Once disconnected from the BHA, the tubing string may be extracted from the borehole and the stuck BHA subsequently retrieved via fishing, jarring or another operation.

A variety of conventional axial disconnects have been used to decouple a coiled tubing string from a downhole tool, such as a BHA. Some conventional disconnects include locking dogs, interlocking fingers, grapples or similar devices which are actuated, such as by application of a hydraulic pressure load, to release the tool coupled thereto. One shortcoming of these disconnects is that the locking dogs, interlocking fingers, and grapples are relatively weak components, in comparison to the other components of the disconnect. Another shortcoming is that the disconnects are usually thin-walled. Both design characteristics limit the loads which may be safely applied to the disconnects. Other conventional disconnects may be capable of handling higher loads. However, those disconnects are typically very sophisticated tools, having many working parts, each representing a potential failure point and increased manufacturing cost. These disconnects may also include expensive high strength materials, also increasing costs.

Increased downhole operating loads and costs are pushing the limits of current axial disconnects. Therefore, a stronger axial disconnect that does not resort to expensive materials is desirable. Stronger axial disconnects that also have few working parts, and thus ease manufacturing, installation, or operational complexities and related costs, would likewise be desirable.

SUMMARY

The embodiments described herein provide an apparatus for mechanically engaging and releasably coupling two tubular members, such as for disconnecting a tool from a tool string. In some embodiments, the apparatus includes a first housing member having a first throughbore and a first flowbore in communication with the first throughbore, a second housing member coupled to the first housing member, the second housing member having a second throughbore in communication with the first throughbore, and a piston member disposed within at least a portion of the first and second throughbores, the piston member having a second flowbore in fluid communication with the first flowbore and moveable from a first position to a second position, wherein, in the first position, the first and second housing members are fixed relative to each other by the piston, and wherein, in the second position, the second housing member is rotatable relative to the first housing member.

In certain embodiments an apparatus includes a first tubular member having a first set of axially disposed splines and a first set of axially offset splines, a second tubular member having a second set of axially disposed splines and a second set of axially offset splines matingly engaged with the first set of axially offset splines, and a moveable member having a third set of axially disposed splines matingly engaged with the first and second sets of axially disposed splines.

In other embodiments an apparatus includes a first tubular member, a second tubular member moveably disposed in the first tubular member, a first interlocking mechanism disposed between the first and second tubular members, and a second interlocking mechanism disposed between the first and second tubular members, the second interlocking mechanism including a moveable member, wherein the first and second interlocking mechanisms are in an opposed relationship to couple the first and second tubular members in a fixed position.

In some embodiments a method includes rotationally coupling a first tubular member into a second tubular member at a first location, aligning the first and second tubulars, translating a moveable member into the first and second tubular members to couple the first and second tubular members at a second location, and reacting the first coupling against the second coupling to resist both axial and rotational movement between the first and second tubulars. Other embodiments include displacing the moveable member to release the second coupling, rotationally disengaging the first tubular from the second tubular member, and removing the first tubular member from the second tubular member.

In certain embodiments, the axially disposed interlocking engagements are in an opposed relationship with the axially offset interlocking engagement such that the anti-rotation of the axially disposed interlocking engagements reacts with the anti-translation of the axially offset interlocking engagement to couple the disconnect such that the primary tubular members are fixed both rotationally and translationally. The axially disposed interlocking mechanism may be moved or disengaged to then remove the opposing reaction forces, and disengage or decouple the axially offset interlocking mechanism. The axially disposed and offset mechanisms may be axially displaced from each other, but interact to provide the opposing reaction forces for coupling and selective release.

The features and characteristics mentioned above, and others, provided by the various embodiments will be readily apparent to those skilled in the art upon reading the following detailed description, and by referring to the accompanying drawings.

DETAILED DESCRIPTION OF THE PREFERRED EMBODIMENTS

In the following discussion and in the claims, the terms "including" and "comprising" are used in an open-ended fashion, and thus are to be interpreted to mean "including, but not limited to . . . ".

Unless otherwise specified, any use of any form of the terms "connect", "engage", "couple", "attach", or any other term describing an interaction between elements is not meant to limit the interaction to direct interaction between the elements and may also include indirect interaction between the elements described.

A tri-lock disconnect system in accordance with the principles described herein may be generally described as a releasable connection for coupling a rotating tool string to a tool, transmitting loads from the tool string to the tool during normal operations of the tool string, and decoupling the tool string from the tool when so desired. While the preferred embodiment of a tri-lock disconnect system is described below in the context of a tool string consisting of a coiled tubing coupled by the disconnect to a BHA, one having ordinary skill in the art will readily appreciate that the disconnect lends itself to other applications as well. For example, a tri-lock disconnect may be inserted into a conventional drill-string between the jointed drill pipe and a downhole tool, such as a BHA. In such applications, actuation of a tri-lock disconnect to decouple the drill pipe from the BHA may be more time and cost effective than decoupling these components using traditional methods, e.g., applying a torque load to the drill pipe to unthread the drill pipe from the BHA.

Figure 1:
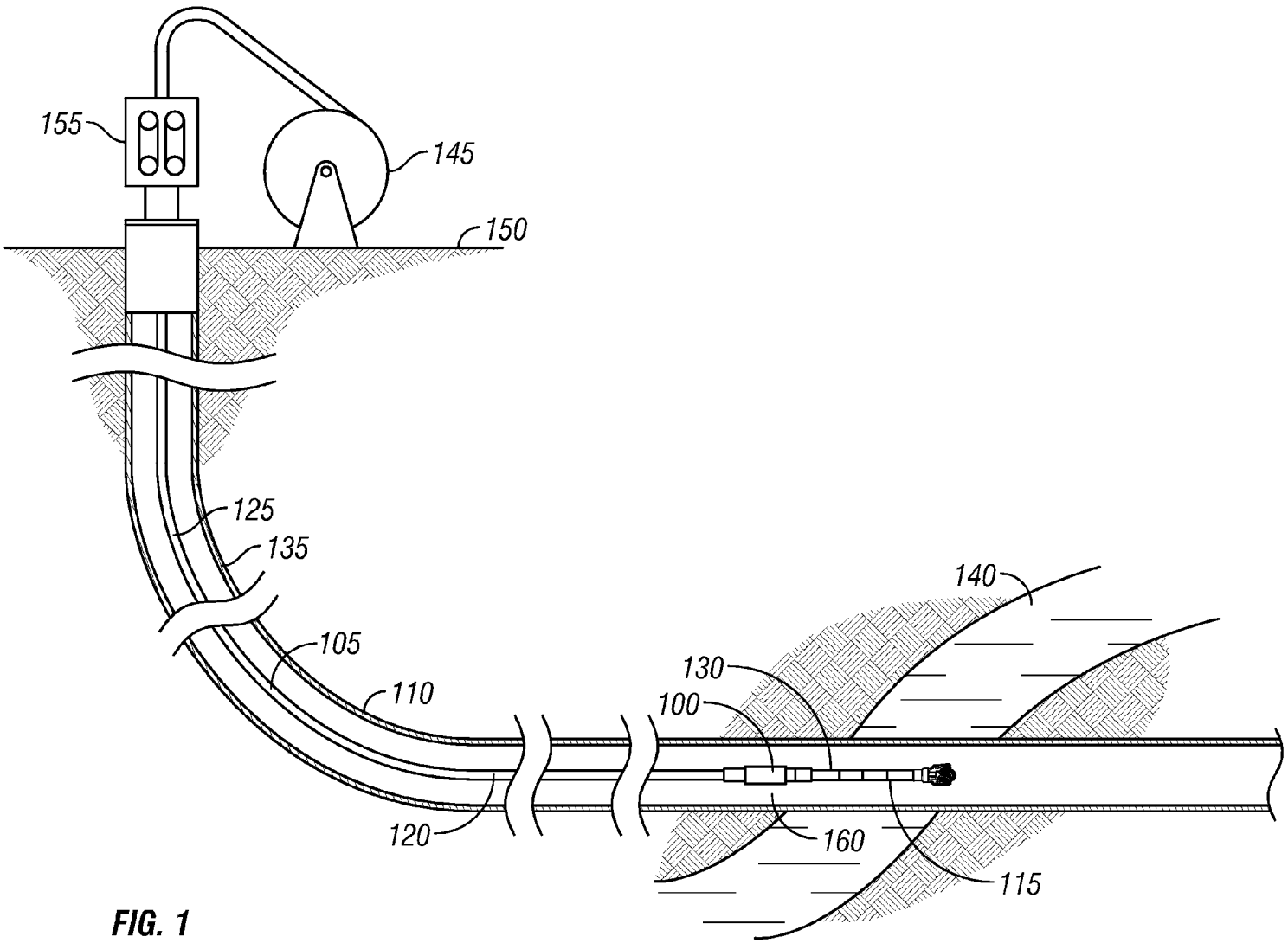
FIG. 1 is a schematic view of a tubing string including a tri-lock disconnect system in accordance with the principles described herein in a deviated well.

Referring now to FIG. 1, an operating environment for a coiled tubing string 105 and an operating tool 115 is shown schematically. An embodiment of a mechanically engaged and releasable connection system 100 is depicted at the lower end of the length of coiled tubing 105 disposed in a well 110. The operating tool 115, such as a bottom hole assembly (BHA), is coupled below disconnect 100. Coiled tubing 105, disconnect 100 and BHA 115 form a tool or tubing string 120, wherein coiled tubing 105 and BHA 115 form an upper portion 125 and a lower portion 130, respectively, of tool string 120. Tool string 120 is positioned in a well casing 135 intersecting a downhole formation or zone of interest 140. An annulus 160 is formed between tool string 120 and well casing 135. Coiled tubing 105 is stored on a reel 145 at the surface 150 and is run into casing 135 and well 110 by a tubing injector 155. Other conventional components of well 110 at the surface 150 are omitted for clarity.

Figure 2:
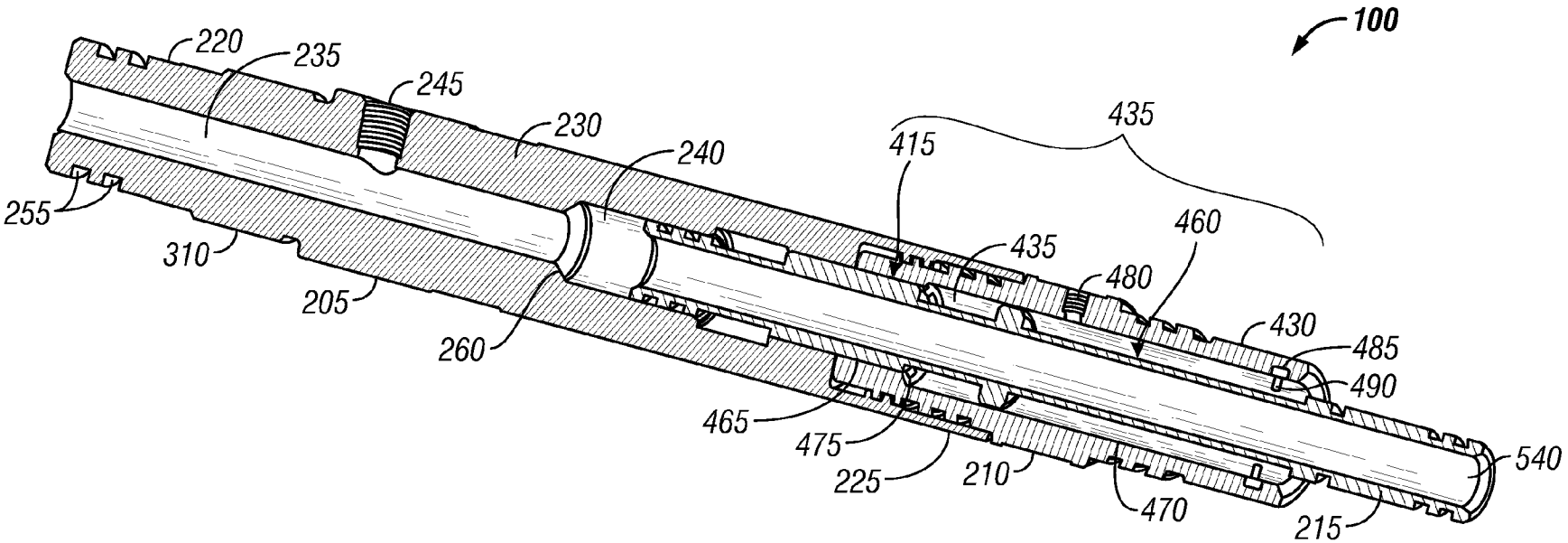
FIG. 2 is a perspective, cross-sectional view of the tri-lock disconnect system of FIG. 1.

Referring next to FIG. 2, an embodiment of the tri-lock disconnect system 100 as assembled includes three working parts, specifically, a first tubular or lower housing member 205 coupled to a second tubular or upper housing member 210 and a piston 215 disposed therein. Lower housing member 205 has two ends 220, 225 with an annular body 230 extending therebetween. End 220 of lower housing member 205 is the downhole end of disconnect 100. As such, end 220 of lower housing member 205 may be coupled to a first tubular member, such as lower tubing portion 130 of tool string 120 (FIG. 1). In this exemplary embodiment, disconnect 100 is coupled to lower tubing portion 130 by a plurality of threads 305 (best viewed in FIG. 3) located on an outer surface 310 of lower housing member 205. To provide a fluid-tight coupling at this location, lower housing member 205 further includes two grooves 255 in outer surface 310 proximate threads 305. Each groove 255 is configured to receive a sealing element, such as an O-ring, (not shown) prior to the coupling of lower housing member 205 with lower tubing portion 130. End 225 couples to upper housing member 210, as will be described.

Lower housing member 205 further includes a flowbore 235 extending therethrough from end 220 of body 200 and an increased diameter throughbore 240 extending therethrough from end 225 to flowbore 235. The size of flowbore 235 is selected to allow fluid flow therethrough at a desired rate during normal operations of tool string 120. The size and shape of throughbore 240 is selected to receive upper housing member 210 and piston 215, as shown in FIG. 2 and described below.

Flowbore 235 of lower housing member 205 is smaller in cross-section than throughbore 240. Thus, a shoulder 260 is formed in body 230 at the transition between flowbore 235 and throughbore 240. Shoulder 260 limits the depth to which piston 215 may translate into lower housing member 205.

Figure 3:
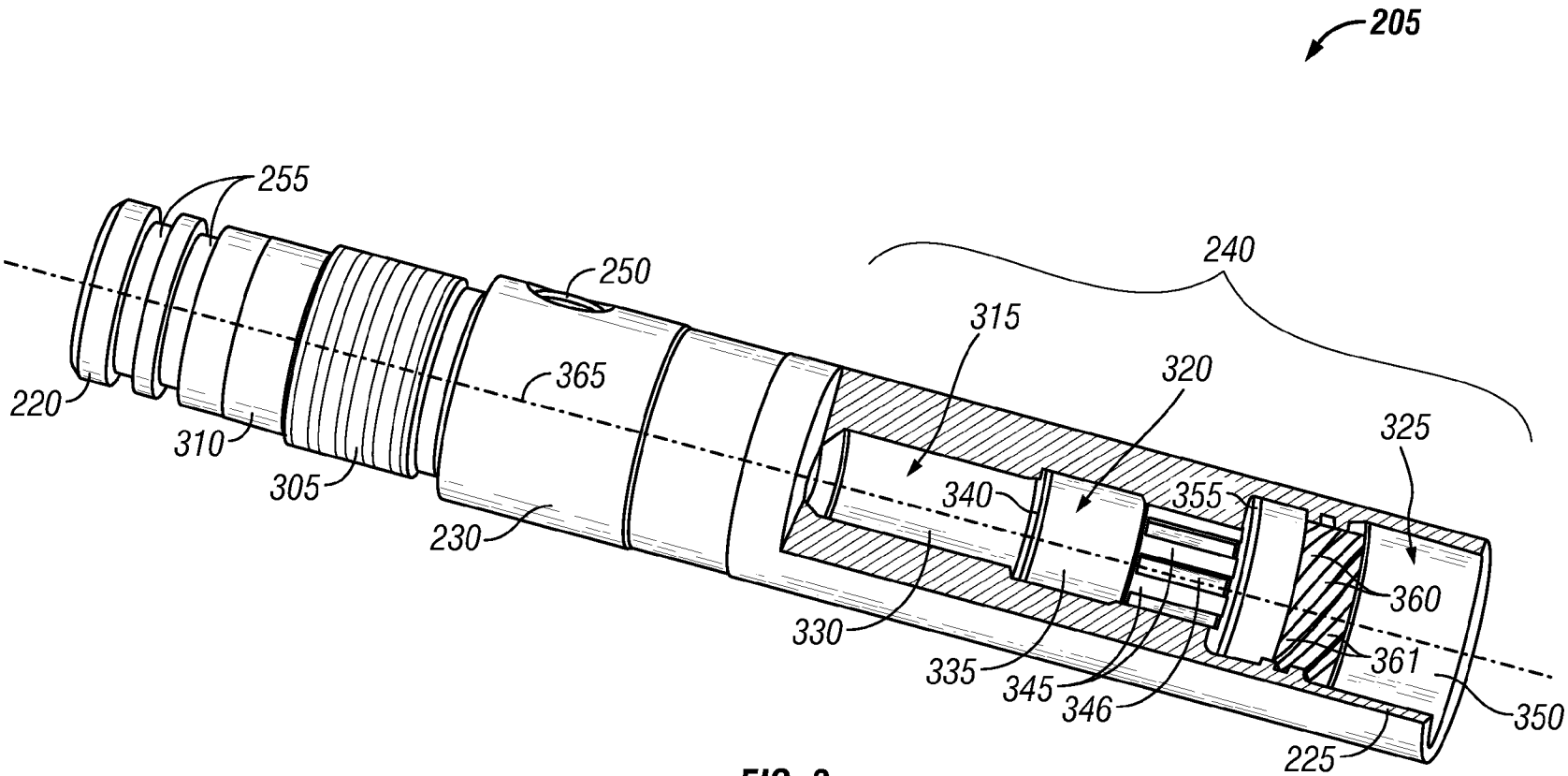
FIG. 3 is a perspective view of the lower housing member of FIG. 1 in partial cross-section.

Referring now to FIG. 3, throughbore 240 of lower housing member 205 includes a first portion 315, a second increased diameter portion 320, and a third increased diameter portion 325. First and second portions 315, 320 are configured to receive piston 215, while third portion 325 is configured to receive upper housing member 210. First portion 315 is bounded by a generally cylindrical inner surface 330 of body 230 configured to sealingly engage piston 215 when piston 215 is inserted into first portion 315 of throughbore 240, as shown in FIG. 2. Second portion 320 is bounded by a generally cylindrical inner surface 335. The cross-section of first portion 315 is smaller than that of second portion 320. Thus, a shoulder 340 is formed in body 230 surrounding throughbore 240 at the transition between first and second portions 315, 320.

A first plurality of splines 345 is formed over a portion of inner surface 335. Each spline 345 has a length extending substantially parallel to a longitudinal axis 365 through lower housing member 205 and a height that extends substantially radially inward from inner surface 335. Thus, the splines 345 may also be referred to as longitudinally or axially disposed splines. A recess 346 is formed between each pair of adjacent splines 345. Splines 345 are configured to matingly engage and interlock with another set of splines formed on the outer surface of piston 215, as will be described. When the axially disposed interlocking splines are so engaged, they form an interlocking mechanism between lower housing member 205 and piston 215 to prevent relative rotation therebetween.

Still referring to FIG. 3, third portion 325 of throughbore 240 is bounded by a generally cylindrical inner surface 350 of body 230 configured to sealingly engage upper housing member 210 when upper housing member 210 is inserted into third portion 325 of throughbore 240. The cross-section of second portion 320 is smaller than that of third portion 325. Thus, a shoulder 355 is formed in body 230 surrounding throughbore 240 at the transition between second portion 320 and third portion 325. Shoulder 355 limits the depth to which upper housing member 210 may be inserted into lower housing member 205.

To enable coupling of upper and lower housing members 210, 205, as shown in FIG. 2, a first plurality of axially offset or spiral splines 360 are formed over a portion of inner surface 350. Each spline 360 has a length that extends circumferentially over a portion of inner surface 350 and is angularly offset relative to longitudinal axis 365. Thus, the splines 360 may also be referred to as longitudinally or axially offset splines. Each spline 360 also has a height that extends substantially radially inward from inner surface 350. A recess 361 is formed between each pair of adjacent splines 360. Spiral splines 360 are configured to matingly engage and interlock with a set of spiral splines formed on the outer surface of upper housing member 210, as will be described. Upper and lower housing members 210, 205 are coupled together by engaging and interlocking spiral splines 360 with matching spiral splines on upper housing member 210 to form an interlocking mechanism, as will be described. The interlocking mechanism prevents relative axial displacement between the members 210, 205 when combined with the other components described herein.

Lower housing member 205 further includes a recirculation port 245 (best viewed in FIG. 2) with a burst disc 250 seated therein. Burst disc 250 is configured to rupture when fluid pressure in flowbore 235 significantly exceeds the expected pressure range of fluid passing through flowbore 235 during normal operations of tool string 120. For example, assuming that the pressure of fluid passing through flowbore 235 during normal operations of tool string 120 is expected to be no greater than 3,000 psi, burst disc 250 may be configured to rupture at fluid pressures in excess of 5,000 psi. Once burst disc 250 ruptures, recirculation port 245 provides fluid communication between flowbore 235 and annulus 160 (FIG. 1).

Figure 4:
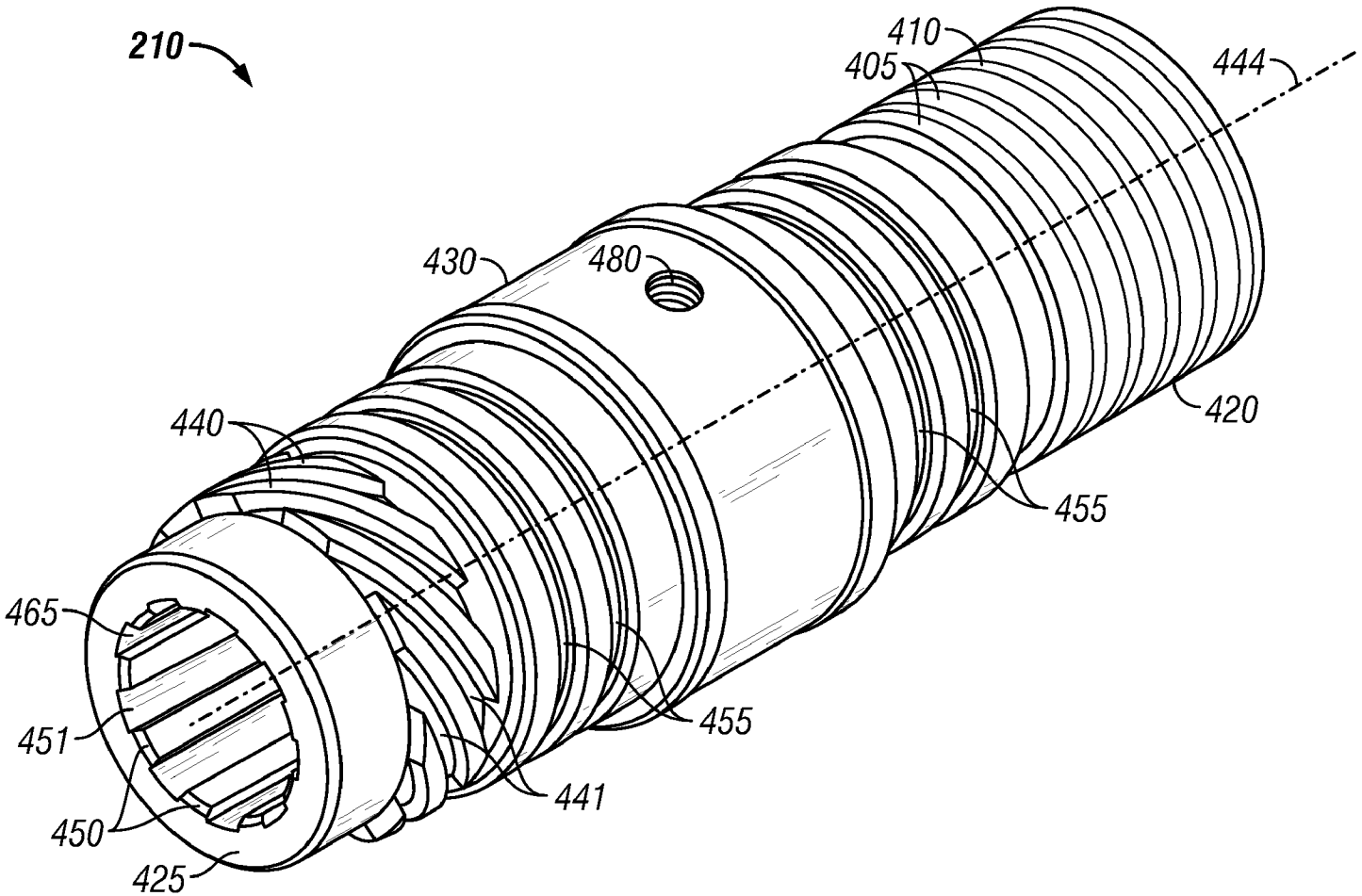
FIG. 4 is a perspective view of the upper housing member of FIG. 1.

Turning now to FIG. 4, upper housing member 210 has two ends 420, 425 with an annular body 430 extending therebetween. End 420 of upper housing member 210 is the uphole end of disconnect 100. As such, end 420 of upper housing member 210 is coupled to a second tubular member, such as upper tubing portion 125 of tubing string 120 (FIG. 1). In this exemplary embodiment, disconnect 100 is coupled to upper tubing portion 125 by a plurality of threads 405 located on an outer surface 410 of upper housing member 210. To provide a fluid-tight connection at this location, upper housing member 210 further includes two grooves 455 in outer surface 410 proximate threads 405. Each groove 455 is configured to receive a sealing element, such as an O-ring, prior to the coupling of upper housing member 210 with upper tubing portion 125. End 425 couples to lower housing member 205, as will be described. To provide a fluid-tight connection at this location, upper housing member 210 further includes two grooves 455 in outer surface 410 proximate end 425. Each groove 455 is configured to receive a sealing element, such as an O-ring, prior to the coupling of upper housing member 210 with lower housing member 205.

Referring also to FIG. 2, body 430 includes a throughbore 435 extending therethrough. Throughbore 435 includes a first portion 415 and an increased diameter second portion 460. First portion 415 is bounded by a generally cylindrical inner surface 465 of body 430, while second portion 460 is bounded by a generally cylindrical inner surface 470 of body 430. A second plurality of splines 450 is formed on inner surface 465. Each spline 450 has a length extending substantially parallel to a longitudinal axis 444 through upper housing member 210 and a height that extends substantially radially inward from inner surface 465. Thus, the splines 450 may also be referred to as longitudinally or axially disposed splines. A recess 451 is formed between each pair of adjacent splines 450. Splines 450 are similar to splines 345 formed on inner surface 335 of lower housing member 205. Further, splines 450, like splines 345, are configured to matingly engage and interlock with the set of splines formed on the outer surface of piston 215, as will be described. When the axially disposed interlocking splines are so engaged, they form an interlocking mechanism between upper housing member 210 and piston 215 to prevent relative rotation therebetween.

The cross-section of first portion 415 is smaller than that of second portion 460. Thus, a shoulder 475 is formed in body 430 surrounding throughbore 435 at the transition between first portion 415 and second portion 460. When upper housing member 210 is decoupled from lower housing member 205 and extracted from well 110 (FIG. 1), shoulder 475 retains piston 215 within throughbore 435 of upper housing member 210 so that piston 215 is removed from well 110 with upper housing member 210.

Upper housing member 210 further includes a second plurality of axially offset or spiral splines 440 formed over a portion of outer surface 410 proximate end 425. Each spline 440 has a length that extends circumferentially over a portion of outer surface 410 and is angularly offset relative to longitudinal axis 444. Thus, the splines 440 may also be referred to as longitudinally or axially offset splines. Each spline 440 also has a height that extends substantially radially outward from outer surface 410. A recess 441 is formed between each pair of adjacent splines 440. Spiral splines 440 are configured to matingly engage and interlock with the first plurality of spiral splines 345 formed over a portion of inner surface 335 of lower housing member 205. Upper housing member 210 and lower housing member 205 are coupled by engaging or interlocking spiral splines 440, 345, as will be described below.

Upper housing member 210 further includes a recirculation port 480 through body 430 and a plurality of recesses 485 formed in inner surface 470 proximate end 420. Recirculation port 480 provides fluid communication between flowbore 435 and annulus 160 (FIG. 1). Each recess 485 is configured to receive a shear pin or screw 490. Shear pins 490 engage a shear groove located on the outer surface of piston 215 when piston 215 is disposed within upper housing member 210, as shown in FIG. 2 and described in more detail below.

Figure 5:
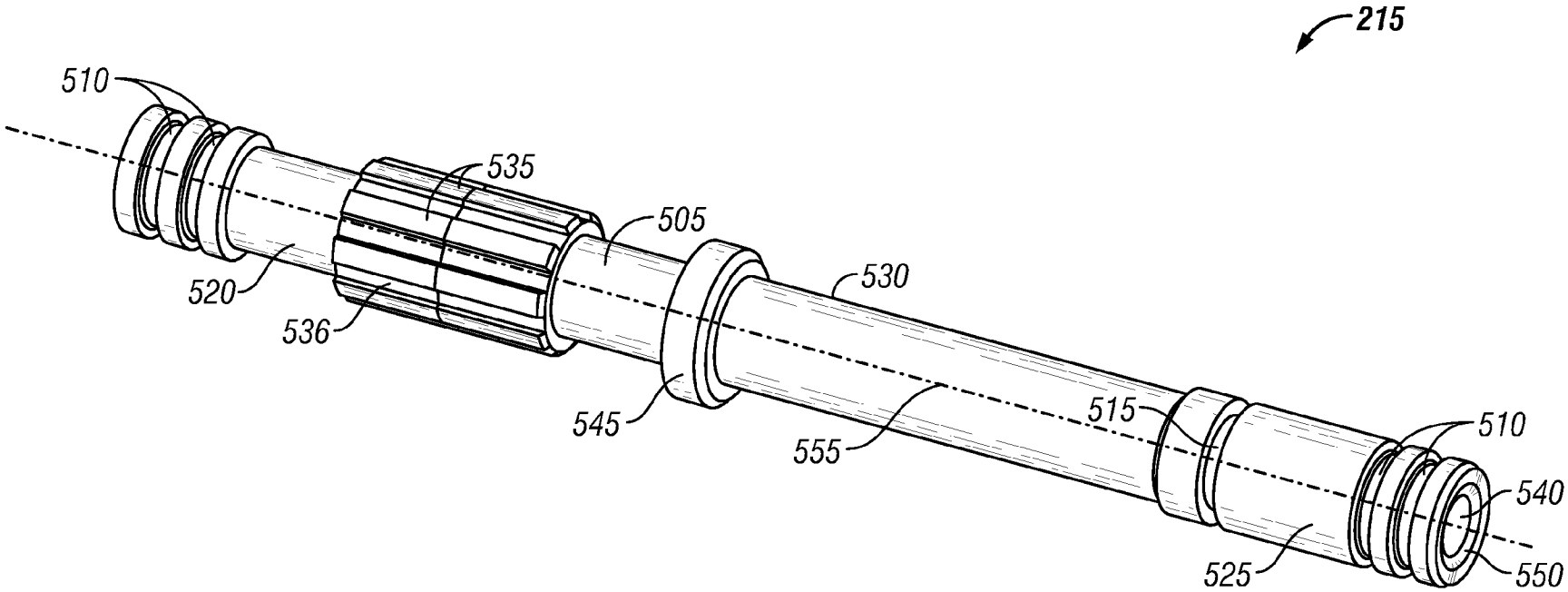
FIG. 5 is a perspective view of the piston of FIG. 1.

Turning finally to FIG. 5, piston 215 has two ends 520, 525 with an annular body 530 extending therebetween. A flowbore 540 extends through body 530 from end 525 to end 520. Proximate each end 520, 525, piston 215 further includes a pair of grooves 510 formed in an outer surface 505 of piston 215. Each groove 510 is configured to receive a sealing element, such as an O-ring. When end 520 of piston 215 is inserted into first portion 315 of throughbore 240 of lower housing member 205, as shown in FIG. 2, end 520 of piston 215 sealingly engages inner surface 330 of lower housing member 205. Similarly, when disconnect 100, or more specifically, end 420 of upper housing member 210, is coupled to upper portion 125 of tubing string 120, end 525 of piston 215 sealingly engages the inner surface of upper portion 125.

Piston 215 further includes a shear groove 515 adjacent grooves 510 proximate end 525. When end 520 of piston 215 is inserted through upper housing member 210 and into throughbore 240 of lower housing member 205, as shown in FIG. 2, shear pins 490 extending from recesses 485 in upper housing member 210 engage shear groove 515, whereby piston 215 is suspended by shear pins 490 within upper and lower housing members 210, 205 and prevented from further translation relative to upper and lower housing members 210, 205. The size and quantity of shear pins 490 supporting piston 215 in this manner are selected to ensure piston 215 remains suspended when exposed to the full range of fluid pressures expected during normal operations of tool string 120. However, when piston 215 is exposed to significantly higher pressures, such as when flowbore 540 is blocked and fluid may not pass therethrough, the pressure forces acting on piston 215 cause pins 490 to shear, thereby allowing piston 215 to displace in the downhole direction, or further into lower housing member 205.

Piston 215 further includes a third plurality of splines 535 over a portion of outer surface 505 that were previously referenced regarding interlocking engagement with first and second pluralities of splines 345, 450. Each spline 535 extends substantially radially outward from outer surface 505. Each spline 535 has a length extending substantially parallel to a longitudinal axis 555 through piston 215. Thus, the splines 535 may also be referred to as longitudinally or axially disposed splines. A recess 536 is formed between each pair of adjacent splines 535. Further, the axial length of splines 535 is selected such that they extend into, engage, and interlock simultaneously with both sets of first and second splines 345, 450 of lower and upper housing members 205, 210, respectively. When piston 215 is inserted into lower and upper housing members 205, 210 and suspended by shear pins 490, as shown in FIG. 2, splines 535 of piston 215 interlock with splines 345, 450 of lower and upper housing members 205, 210, respectively. Once interlocked, upper and lower housing members 210, 205 are prevented from rotating relative to or about piston 215, as well as relative to each other.

Piston 215 further includes a flanged portion or stop ring 545 extending from outer surface 505. Stop ring 540 is configured such that its cross-section is larger than that of first portion 415 of throughbore 435 of upper housing member 210. When upper housing member 210 is decoupled from lower housing member 205 and extracted from well 110, piston 215 is retained with upper housing member 210 by virtue of contact between shoulder 475 of upper housing member 210 and stop ring 545 of piston 215. The interaction between shoulder 475 and stop ring 545 prevents piston 215 from translating out of throughbore 435 and instead allows piston 215 to be removed from well 110 along with upper housing member 210.

In order to decouple upper portion 125 of tubing string 120 from BHA 115, disconnect 100 must first be actuated. After actuation, upper housing member 210 may be decoupled from lower housing member 205. The exemplary embodiment of a tri-lock disconnect system depicted in FIGS. 2-5 and described herein is hydraulically actuated. For this purpose, piston 215 further includes a ball seat 550 at end 525. Other embodiments of a tri-lock disconnect system, however, may be actuated in other ways, such as by mechanical or electrical means.

To actuate disconnect 100, a ball is dropped from the surface 150 through tool string 120 to disconnect 100 where it lands on ball seat 550 and prevents further fluid from passing into flowbore 540 of piston 215. As a result, fluid pressure builds upstream of piston 215 until the pressure load on piston 215 causes shear pins 490 to sever. Once shear pins 490 sever, piston 215 translates downward into lower housing member 205 until abutting shoulder 260 of lower housing member 205. When piston 215 comes to rest against shoulder 260, splines 535 of piston 215 are fully disengaged from splines 450 on upper housing member 210, and upper housing member 210 is free to rotate relative to lower housing member 205.

The assembly and operation of disconnect 100 will now be described with reference to FIGS. 1 through 5. To assemble disconnect 100, sealing elements, such as O-rings, are inserted into grooves 455 on upper housing member 210, grooves 510 on piston 215, and grooves 255 on lower housing member 205. Upper and lower housing members 210, 205 are then coupled. End 425 of upper housing member 210 is inserted into throughbore 240 of lower housing member 205. When spiral splines 440 on outer surface 405 of upper housing member 210 contact spiral splines 360 on inner surface 350 of lower housing member 205, a compression load is then applied to end 420 of upper housing member 210. Due to the angular nature of spiral splines 440, 360, the applied compression load causes upper housing member 210 to rotate into lower housing member 205. As upper housing member 210 rotates into lower housing member 205, spiral splines 440 engage and interlock with spiral splines 360. More specifically, spiral splines 440 thread into recesses 361 between spiral splines 360, and spiral splines 360 thread into recesses 441 between spiral splines 440. Rotation of upper housing member 210 in this manner continues until end 425 of upper housing member 210 abuts shoulder 355 of lower housing member 205 and spiral splines 440, 360 are fully interlocked, as shown in FIG. 2. In some embodiments, upper housing member 210 need only be turned ¾ of a rotation to fully couple within lower housing member 205. Further, when spiral splines 440, 360 are fully engaged, longitudinal splines 345 on inner surface 335 of lower housing member 205 are adjacent to and align with longitudinal splines 450 on inner surface 465 of upper housing member 210.

Next, piston 215 is inserted into upper and lower housing members 210, 205. End 520 of piston 215 is inserted through throughbore 435 of upper housing member 210 and into throughbore 240 of lower housing member 205. Once end 520 of piston 215 passes into throughbore 240, piston 215 may be rotated relative to the assembly of upper and lower housing members 210, 205, if necessary, to align longitudinal splines 535 on outer surface 505 of piston 215 with recesses 451, 346 between longitudinal splines 450, 345 on inner surfaces 465, 335 of upper and lower housing members 210, 205, respectively. When longitudinal splines 535 align with recesses 451, 346, end 520 of piston 215 may be further inserted into throughbore 240 until shear pins 490 extending from recesses 485 of lower housing member 205 engage shear groove 515 of piston 215, thereby preventing further translation of piston 215 within upper and lower housing members 210, 205.

Once shear pins 490 engage shear groove 515 and piston 215 ceases to translate, longitudinal splines 535 of piston 215 are fully interlocked with longitudinal splines 450, 345 of upper and lower housing members 210, 205, respectively, as shown in FIG. 2. When splines 535 are interlocked with splines 450, 345, rotation of upper and lower housing members 210, 205 relative to piston 215 is prevented, as previously described. As long as upper and lower housing members 210, 205 cannot rotate relative to each other, spiral splines 440 on upper housing member 440 cannot disengage or unthread from spiral splines 345 on lower housing member 205.

Disconnect 100 is now fully assembled. Due to the engagement of longitudinal splines 535 on piston 215 with longitudinal splines 345, 450 on lower and upper housing members 205, 210, respectively, lower and upper housing members 205, 210 cannot rotate relative to piston 215. Since such rotation is prevented, spiral splines 440 on upper housing member 210 cannot disengage or unthread from spiral splines 360 of lower housing member 205 upon application of a tension load to upper housing member 210. Thus, disconnect 100 includes three interlocking engagements, one between piston 215 and lower housing member 205, another between piston 215 and upper housing member 210, and the third between upper and lower housing members 210, 205. Hence, disconnect 100 is also referred to as a tri-lock connection system or a tri-lock disconnect. The axially disposed interlocking engagements are in an opposed relationship with the axially offset interlocking engagement such that the anti-rotation of the axially disposed interlocking engagements reacts with the anti-translation of the axially offset interlocking engagement to couple the disconnect 100 such that the primary tubular members are fixed both rotationally and translationally. The axially disposed interlocking mechanism may be moved or disengaged to then remove the opposing reaction forces, and disengage or decouple the axially offset interlocking mechanism. The axially disposed and offset mechanisms may be axially displaced from each other, but interact to provide the opposing reaction forces for coupling and selective release. It is understood that the term "splines" as used herein does not merely include those shown in the drawings, but also other surfaces which effect the interlocking engagements described herein. The interlocking mechanisms between the various tubular members may also include teethed arrangements, tongue and groove arrangements, ridge and valley arrangements or other surfaces providing mating and interlocking engagement.

Disconnect 100 is next coupled between BHA 115 and coiled tubing 105 to form tubing string 120. Tubing string 120 is then inserted into well 110, and BHA 115 is operated to form well 110. During normal operations of tubing string 120, fluid is injected downhole through coiled tubing 105 to disconnect 100. Fluid passes through disconnect 100 via flowbore 540 of piston 215, throughbore 240 of lower housing member 205, and flowbore 235 of lower housing member 205 (FIG. 2). From disconnect 100, the fluid passes through BHA 115 and then returns to the surface 150 (FIG. 1) via annulus 160. Also during normal operations, interlocked spiral splines 440, 360 and interlocked longitudinal splines 345, 450 allow significant loads to be transferred through disconnect 100. Specifically, tension loads applied to disconnect 100 by coiled tubing 105 are carried by spiral splines 440, 360, while any torsional loads are borne by longitudinal splines 345, 450, 535. These loads as well as pressure fluctuations in fluid passing through tubing string 120 during normal operations will not inadvertently actuate disconnect 100 and/or decouple upper housing member 210 from lower housing member 205.

Actuation of disconnect 100 requires severance of shear pins 490. Their quantity and size have been selected such that their combined strength is capable of suspending piston 215 within upper and lower housing members 210, 215, as shown in FIG. 2, under the full range of fluid pressures expected during normal operations of tubing string 120. Fluid pressure fluctuations acting on piston 215 during normal operations are insufficient to cause piston 215 to sever shear pins 490, and thus actuate disconnect 100. At the same time, any load applied to disconnect 100 by coiled tubing 105 acts on upper housing member 210, not piston 215. Hence, piston 215 is unaffected by the applied loads, and shear pins 490 remain intact.

Decoupling of upper housing member 210 from lower housing member 205 requires actuation of disconnect 100 and a tension load subsequently applied to upper housing member 205. Due to the angled nature of spiral splines 440, 360 on upper and lower housing members 210, 205, respectively, a tension load applied to disconnect 100 through coiled tubing 105 will cause upper housing member 210 to rotate relative to lower housing member 205 and spiral splines 440 to disengage from spiral splines 360, unless rotation of upper housing member 210 relative to lower housing member 205 is prevented. Until disconnect 100 is actuated, longitudinal splines 535 on piston 215 remain fully interlocked with longitudinal splines 345, 465 on lower and upper housing members 205, 210, and rotation of upper housing member 210 relative to lower housing member 205 is prevented. Hence, spiral splines 440 cannot disengage from spiral splines 360, and upper housing member 210 cannot be decoupled from lower housing member 205. Thus, loads applied to disconnect 100 during normal operation of tubing string 120 will not cause actuation of disconnect 100 and decoupling of coiled tubing 105 from BHA 115.

In the event that BHA 115 becomes stuck during operation of tubing string 120 and fluid flow through BHA 115 is prevented, fluid pressure within disconnect 100 begins to rise in response. When the pressure of fluid contained within flowbore 235 of disconnect 100 exceeds the burst pressure rating of disc 250, disc 250 ruptures. Fluid within disconnect 100 is then allowed to flow from flowbore 235 through recirculation port 245 to annulus 160. Should it become desirable to decouple coiled tubing 105 from BHA 115 so that coiled tubing 105 may be removed from well 110 and the stuck BHA 115 subsequently retrieved, disconnect 100 may be actuated to allow upper housing member 210 to decouple from lower housing member 205 upon application of a tension load to upper housing member 210.

To actuate disconnect 100, a ball is dropped from surface 150 into tubing string 120. Fluid passing through tubing string 120 carries the ball to disconnect 100 where the ball lands on ball seat 550 of piston 215. Once seated, the ball prevents further fluid flow into flowbore 540 of piston 215. As a result, fluid pressure upstream of piston 215 begins to build. When the fluid pressure acting on piston 215 causes piston 215 to exert loads on shear pins 490 in excess of their combined strength, pins 490 shear. Piston 215 then translates in the downhole direction, or further into throughbore 240 of lower housing member 205, until end 520 of piston 215 abuts shoulder 260 on lower housing member 205.

When piston 215 comes to rest against shoulder 260, longitudinal splines 535 on piston 215 are fully disengaged from longitudinal splines 465 on upper housing member 210, but remained interlocked with longitudinal splines 345 on lower housing member 205. Upper housing member 210 is then free to rotate relative to lower housing member 205 and piston 215, while lower housing member 205 is still prevented from rotational movement due to the engagement of longitudinal splines 345 on lower housing member 205 with longitudinal splines 535 on piston 215.

A tension load is then applied to disconnect 100 via coiled tubing 105. In response, upper housing member 210 is pulled in the uphole direction. Due to the angular nature of spiral splines 440, 360 on upper and lower housing members 210, 205, respectively, upper housing member 210 rotates relative to lower housing member 205 until spiral splines 440, 360 disengage. Once spiral splines 440, 360 disengage, upper housing member 210 is decoupled from lower housing member 205 and returned to the surface 150. Due to interaction between stop ring 545 on piston 215 and shoulder 475 of upper housing member 210, piston 215 is retained within throughbore 435 of upper housing member 210 and returned to the surface 150 along with upper housing member 210. As these components are lifted to the surface 150, fluid contained within coiled tubing 105 flows through flowbore 435 and recirculation port 480 of upper housing member 210 to annulus 160. After upper housing member 210, piston 215 and coiled tubing 105 have been removed from well 110, BHA 115 with lower housing member 205 coupled thereto may be retrieved via fishing, jarring or other operation.

The above discussion is meant to be illustrative of the principles and various embodiments of the disclosure. The disclosure is susceptible to embodiments of different forms. It is to be fully recognized that the various teachings of the embodiments discussed may be employed separately or in any suitable combination to produce desired results. Many variations and modifications of the apparatus and methods disclosed herein are possible and are within the scope of the disclosure. Accordingly, the scope of protection is not limited by the description set out above, but is only limited by the claims which follow, that scope including all equivalents of the subject matter of the claims.

What is claimed is:

1. A connection apparatus comprising:

a first housing member having a first throughbore and a first flowbore in communication with the first throughbore;

a second housing member coupled to the first housing member, the second housing member having a second throughbore in communication with the first throughbore;

a piston member disposed within at least a portion of the first and second throughbores, the piston member having a second flowbore in fluid communication with the first flowbore and moveable from a first position to a second position; and moveable interlocking splines disposed between the piston member and the housing members;

wherein, in the first position, the first and second housing members are fixed relative to each other by the piston member; and wherein, in the second position, the second housing member is rotatable relative to the first housing member.

2. The apparatus of claim 1 wherein the moveable interlocking splines include a first set of mating axially disposed splines and a second set of mating axially offset splines displaced axially from the first set.

3. The apparatus of claim 1 further comprising a shear pin engaged between the piston member and the second housing member supporting the piston member in the first position.

4. The apparatus of claim 1, wherein the second housing member further comprises a shoulder extending substantially radially into the second throughbore and wherein the piston member further comprises an outer surface with a flanged portion extending substantially radially outward therefrom, wherein a cross-section of the flanged portion is greater than a cross-section of the second throughbore at the shoulder.

5. The apparatus of claim 1, wherein the first housing member further comprises a recirculation port configured to allow fluid communication between the first flowbore and a flow annulus surrounding the first housing member.

6. The apparatus of claim 5, wherein the first housing member further comprises a burst disc disposed within the recirculation port, wherein the burst disc is configured to rupture when fluid pressure within in the first flowbore exceeds a selected value, wherein fluid communication is established between the first flowbore and the annulus when the burst disc ruptures.

7. The apparatus of claim 1, wherein the second housing member further comprises a recirculation port configured to allow fluid communication between the second throughbore and a flow annulus surrounding the second housing member.

8. The apparatus of claim 1, wherein a drillstring is coupled to the second housing member.

9. The apparatus of claim 2, wherein the second set of mating axially offset splines includes a first set of spiral splines on the first housing member and a second set of spiral splines on the second housing member, wherein the second set of spiral splines decouples from the first set of spiral splines upon application of a tension load.

10. The apparatus of claim 1 further comprising:

a first set of axial splines on the first housing member;

a second set of axial splines on the second housing member; and a third set of axial splines on the piston member;

wherein when the piston member is in the first position, the third set of axial splines interlocks with the first and the second sets of axial splines; and wherein when the piston member is in the second position, the third set of axial splines interlocks with the first set of axial splines and decouples from the second set of axial splines.

11. An apparatus comprising:

a first tubular member having a first set of axially disposed splines and a first set of axially offset splines;

a second tubular member having a second set of axially disposed splines and a second set of axially offset splines matingly engaged with the first set of axially offset splines; and a moveable member having a third set of axially disposed splines matingly engaged with the first and second sets of axially disposed splines.

12. The apparatus of claim 11, wherein:

the first set of axially disposed splines is formed on a first inner surface of the first tubular member;

the second set of axially disposed splines is formed on an inner surface of the second tubular member;

the third set of axially disposed splines is formed on an outer surface of the piston member;

the first set of axially offset splines is formed on a second inner surface of the first tubular member; and the second set of axially offset splines is formed on an outer surface of the second tubular member.

13. The apparatus of claim 11, wherein the first tubular member cannot rotate about a longitudinal axis of the apparatus relative to the second tubular member and wherein the second tubular member cannot translate along the longitudinal axis relative to the first tubular member.

14. The apparatus of claim 13, wherein the moveable member is translatable along the first, second and third sets of axially disposed splines to allow decoupling of the first and second sets of axially offset splines.

15. An apparatus comprising:

a first tubular member;

a second tubular member moveably disposed in the first tubular member;

a first interlocking mechanism disposed between the first and second tubular members; and a second interlocking mechanism disposed between the first and second tubular members, the second interlocking mechanism including a moveable member;

wherein the first and second interlocking mechanisms are in an opposed relationship to couple the first and second tubular members in a fixed position.

16. The apparatus of claim 15 wherein the first and second interlocking mechanisms are axially displaced from each other.

17. The apparatus of claim 15 wherein the first interlocking mechanism includes an anti-translation mechanism reacting against an anti-rotation mechanism of the second interlocking mechanism.

18. A method for coupling two tubular members comprising:

rotating a first tubular member relative to a second tubular member to engage an axially offset interlocking mechanism disposed between the first and second tubular member;

aligning portions of an axially disposed interlocking mechanism on the first and second tubulars in response to the rotating;

translating a moveable member into the first and second tubular members to engage the axially disposed interlocking mechanism portions on the first and second tubular members; and reacting the engaged axially offset interlocking mechanism against the engaged axially disposed interlocking mechanism to couple the first and second tubular members in a fixed position.

19. The method of claim 18 further comprising:

resisting axial movement between the first and second tubular members using the engaged axially offset interlocking mechanism;

resisting rotational movement between the first and second tubular members using the engaged axially disposed interlocking mechanism; and reacting the anti-rotation forces of the engaged axially disposed interlocking mechanism against the anti-translation forces of the engaged axially offset interlocking mechanism to couple the first and second tubular members.

20. The method of claim 18 further comprising:

displacing the moveable member to release the axially disposed interlocking mechanism;

rotating the first tubular relative to the second tubular member to release the axially offset interlocking mechanism; and removing the first tubular member from the second tubular member.

* * * * *